US005858282A

United States Patent [19]

Seiner et al.

[11] Patent Number: 5,858,282

[45] Date of Patent: Jan. 12, 1999

[54] AQUEOUS AMINE FLUORIDE NEUTRALIZING COMPOSITION FOR METAL PRETREATMENTS CONTAINING ORGANIC RESIN AND METHOD

[75] Inventors: Jerome A. Seiner, Pittsburgh; Michael J. Pawlik, Glenshaw, both of Pa.

[73] Assignee: PPG Industries, Inc., Pittsburgh, Pa.

[21] Appl. No.: 975,515

[22] Filed: Nov. 21, 1997

[51] Int. Cl.[6] ..... C23C 22/02; C09K 3/00

[52] U.S. Cl. ..... 252/389.1; 252/389.22; 252/389.23

[58] Field of Search ..... 252/389.1, 389.22, 252/389.23

[56] References Cited

U.S. PATENT DOCUMENTS

| | | | |
|---|---|---|---|
| 3,895,970 | 7/1975 | Blum et al. | 148/6.15 R |
| 5,023,074 | 6/1991 | Morton et al. | 424/52 |
| 5,034,556 | 7/1991 | Kahle, II | 558/155 |
| 5,129,967 | 7/1992 | Sander et al. | 148/247 |
| 5,294,265 | 3/1994 | Gray et al. | 148/250 |
| 5,306,526 | 4/1994 | Gray et al. | 427/309 |
| 5,584,946 | 12/1996 | Karmaschek et al. | 148/247 |

*Primary Examiner*—Jerry D. Johnson
*Attorney, Agent, or Firm*—Kenneth J. Stachel

[57] ABSTRACT

An amine fluoride neutralizing composition comprised of (a) about 1 to about 50 weight percent hydrofluoric acid, (b) optionally up to about 18 weight percent of a complex fluoride containing compound, and about 45 to about 99 weight percent of an amine. The weight percentages are based on the total solids of the amine fluoride neutralizing composition. Also provided is a method of using the amine fluoride to produce a non-chrome pretreatment composition comprised of mixing from about 20 to about 30 weight percent of the amine fluoride neutralizing composition with about 70 to about 80 weight percent of at least one organic resinous material having an organic resinous material that is amine neutralizable; and adding water so as to achieve a total solids content of the non-chrome pretreatment composition of about 20 to about 60 weight percent. The pretreatment composition may be further diluted with water to form a non-chrome pretreatment bath having a total solids content of about 0.1 to about 10 weight percent, preferably from about 1 to about 5 weight percent. The amine fluoride neutralizing composition allows for a simplified manufacturing process of non-chrome pretreatment compositions by allowing the use of one, less corrosive, easy to handle compound rather than three separate materials which may be hazardous to handle, and it allows for the insertion of fluoride into a pretreatment composition without the introduction of extraneous cations which can destabilize or diminish the effectiveness of the pretreatment concentrate or bath.

16 Claims, No Drawings

AQUEOUS AMINE FLUORIDE NEUTRALIZING COMPOSITION FOR METAL PRETREATMENTS CONTAINING ORGANIC RESIN AND METHOD

The present invention relates to an amine fluoride neutralizing composition for use in metal pretreatment compositions. More particularly, the present invention relates to an amine fluoride neutralizing composition for use in metal pretreatment compositions containing organic resinous materials and which do not contain at least any added chromium. Such pretreatment compositions are useful in treating nonferrous metal surfaces, particularly aluminum, zinc and aluminum-zinc alloy surfaces and other aluminum alloy surfaces.

It is known to treat metal surfaces, particularly zinc, aluminum and their alloys, with chromium containing compositions to inhibit corrosion and promote adhesion of subsequently applied coatings. While effective, these chromium compounds have become undesirable because of their toxicity and the attendant problems of waste disposal.

Non-chromium pretreatment compositions and methods of treatment have been developed such as described in U.S. Pat. Nos. 5,294,265 and 5,306,526 to Gray, et al. These patents describe compositions and methods that utilize organic resinous materials that have been made water dispersible by neutralization with an amine, and which utilize acidic fluoride compounds to activate the metal surface to be treated.

Typically during the preparation or manufacture of these types of non-chrome pretreatment compositions, the amine and the acidic fluoride compounds, each are added separately along with the separate addition of other components to form the pretreatment concentrate composition or a diluted concentrate or bath for treating metal. Also in the normal consequence of the use of metal pretreatment baths, it is usually necessary to replenish the fluoride in the bath. Typically, fluoride is introduced into the pretreatment concentrates and the spent or fluoride deficient pretreatment baths via hydrofluoric acid or by fluoride or bifluoride salts. Since hydrofluoric acid is corrosive and difficult to work with, precautions are necessary in handling and using it to prepare compositions like the aforementioned pretreatment compositions, baths and replenishers. Also, adding hydrofluoric acid to a fluoride deficient pretreatment bath on a pretreatment line can be an extremely difficult undertaking. The addition of the fluoride and bifluoride salts can introduce extraneous cations into the pretreatment concentrate or bath. The extraneous cations can destabilize the pretreatment composition or diminish the effectiveness of the pretreatment bath.

SUMMARY OF THE INVENTION

It is an object of the present invention to provide an amine fluoride neutralizing composition for use in metal pretreatment compositions that will provide the necessary fluoride to metal pretreatment concentrates, baths, and replenishers that are less corrosive and easier to handle than hydrofluoric acid, and can at least partially neutralize organic resinous materials in the pretreatment concentrate and/or bath compositions.

It is another object of the present invention to provide a method of using the amine fluoride neutralizing composition to produce non-chrome metal pretreatment concentrates, bath and/or replenisher compositions.

These and other objects of the invention are achieved by the development of an aqueous amine fluoride neutralizing composition comprised of (a) about 1 to about 50 weight percent hydrofluoric acid, (b) optionally up to about 18 weight percent of a complex fluoride containing compound, and (c) about 45 to about 99 weight percent of an amine. The weight percentages are based on the solids weight of the component in the total weight of the aqueous amine fluoride composition.

Also provided is a method of preparing non-chrome or no added chrome pretreatment concentrate and/or bath compositions with the aqueous amine fluoride neutralizing composition comprising: mixing from about 20 to about 30 weight percent of said amine fluoride neutralizing composition with about 70 to about 80 weight percent of at least one organic resinous material having at least one or a portion of at least one organic resinous material that is amine neutralizable, and adding water so as to achieve a total solids content of the non-chrome pretreatment composition of about 20 to about 60 weight percent. The pretreatment composition may be further diluted with water to form a pretreatment bath having a total solids content of about 0.1 to about 10 weight percent, preferably from about 1 to about 5 weight percent.

DETAILED DESCRIPTION OF THE INVENTION

Unless otherwise specified, the numerical ranges such as those for amounts of materials, times of reaction and others in the following portion of the specification may be read as if prefaced by the word "about" at each end of the various ranges.

In the term "amine fluoride neutralizing composition", the neutralizing refers to the amine having the capability of interacting with an organic resinous material in a metal treating composition to which the amine fluoride neutralizing composition is added to result in improved water solubility, dispersibility, or emulsifiability for that organic resinous material.

The aqueous amine fluoride composition of the present invention is comprised of hydrofluoric acid, an amine, and, optionally, a complex fluoride containing compound. The hydrofluoric acid which is hydrogen fluoride in an aqueous solution can be of any concentration that is commercially available or any dilution thereof or of any dilution of hydrogen fluoride in water. Commercially available concentrations include 38, 47, 53 and 70 percent technical grades.

The optional complex fluoride containing compound for use in the present invention may include complex fluorotitanium, fluorosilicic, and fluorozirconium compounds such as fluorotitanic acid, fluorozirconic acid, hydrofluorosilicic acid, potassium hexafluorotitanate, potassium hexafluorozirconate, and the like known to those skilled in the art for use in pretreatment compositions. Fluorozirconic acid is the preferred complex fluoride containing compound which is preferably present in the pretreatment composition. These complex fluorides can be present in aqueous solutions in concentrations known to those skilled in the art. Typically, such concentrations include: 23, 45, 50 and 60 percent complex fluoride.

Suitable amines for use in the present invention may include primary, secondary, tertiary amines, and/or alkanolamines known to those skilled in the art to have a capability of assisting in the water solubility, dispersibility, or emulsifiability of an organic material into an aqueous solution. Some non-exclusive examples of amines include: diisopropanolamine, triethanolamine, triethylamine, monoethanolamine, dimethylethanolamine, and 2-amino-2-methylpropanol. Preferably, the amine is diisopropanolamine.

The hydrofluoric acid, optional complex fluoride containing compound, and the amine each may be in an aqueous solution for addition to form the aqueous amine fluoride composition. As noted above the hydrofluoric acid is preferably a 70 percent by weight solution in water. In a preferred embodiment, the amine is diisopropanolamine in an 85 percent by weight solution in water. Also, when present, the complex fluoride containing compound, preferably is hydrofluozirconic acid in a 50 percent by weight solution in water. However, other concentrations of the fluoride-containing acids and the amine in an aqueous solution may also be used.

The aqueous amine fluoride neutralizing composition may be formed by first mixing in a suitable vessel the hydrofluoric acid and any optional complex fluoride containing compound under agitation preferably for 1 to 10 minutes, most preferably from 2 to 5 minutes. To this mixture the amine is added under vigorous agitation over a period long enough to minimize the exotherm, preferably from 1 to 20 minutes, most preferably from 10 to 15 minutes. It is preferable to add the type of amine that will actually neutralize the organic component in the aqueous solution to which the aqueous amine fluoride neutralizing composition is added. Optionally, the acidic fluoride mixture may be added to the amine. The resultant mixture may then be stirred to assure complete mixing and reacting and to dissipate any exotherm, preferably for about 10 minutes. The mixing of the fluoride-containing acids with the amine is exothermic and will result in the generation of a moderate amount of heat; therefore, vigorous agitation is suggested. For safety, it is also suggested that the mixing vessel be a closed mixing vessel. The resultant amine fluoride neutralizing composition typically has a pH of 4 to 12, preferably from 8 to 10, and a weight per gallon of 8.5 to 9.5 pounds per gallon (1020 to 1140 grams per liter). The fluoride ion concentration of the aqueous amine fluoride neutralizing composition generally ranges from 10,000 to 230,000 parts per million (ppm), preferably from 36,000 to 100,000 ppm. The ratio of amine to fluoride in the amine fluoride composition will typically range from 1.5:1 to 35:1, preferably from 5:1 to 28:1. For this ratio, the total weight of the amine compound is considered with the weight of the fluoride atoms in the hydrofluoric acid and complex fluoride containing compounds, if any. The weight percent of the total solids of the aqueous amine fluoride neutralizing composition depends on the amount of organic resinous material that is to be neutralized and the amount of fluoride desired both in the pretreatment composition. Generally, the total solids can be in the range from 5 to 99 and preferably from 50 to 98 and most preferably from 65 to 98, all weight percentages.

The aqueous amine fluoride neutralizing composition may be used in the method of producing non-chrome pretreatment compositions having at least one organic resinous material that is known to those skilled in the art such as those described below. Additionally, the amine fluoride neutralizing composition may be used as a fluoride replenisher to add fluoride to spent or fluoride deficient metal pretreatment baths. Additionally, the aqueous amine fluoride neutralizing composition may be used to adjust the pH of such metal pretreatment baths.

Many non-chrome pretreatment compositions are aqueous solutions of at least one organic resinous material that also contains acidic fluoride to promote surface activation of the metals to be treated. The amine fluoride neutralizing composition of the present invention may be used to enhance the solubility of the any organic resinous material that has limited water solubility and to provide the acidic fluoride in the non-chrome pretreatment composition. The amine fluoride neutralizing composition of the present invention can be added to and mixed with an organic resinous material and water. Generally, 20 to 30 weight percent of the amine fluoride neutralizing composition is mixed with 70 to 80 weight percent of all of the organic resinous material that is present, with the percentages based on resin solids. Sufficient water is added to achieve a total solids content of the non-chrome pretreatment composition of 20 to 60 weight percent. A non-exclusive example of more than one organic resinous material in a metal pretreatment composition would be a water soluble polymer like polyacrylic acid and/or reaction products of polyvinylphenols and aldehydes like those known in the art. The amine of the amine fluoride neutralizing composition would improve aqueous solubility, dispersibility and/or emulsifiability of the latter type of polymer.

In a preferred embodiment, the aqueous amine fluoride neutralizing composition is used to produce or replenish a non-chrome pretreatment composition where the organic resinous materials are organophosphates, which are the epoxy esters of phosphoric acid, or organophosphonates, which are the epoxy esters of a phosphonic acid. Organophosphates are phosphoric acid esters prepared from the reaction of phosphoric acid and an epoxide. Suitable epoxides include 1,2-epoxides having an epoxy equivalent of at least 1, specifically, monoepoxides having a 1,2-epoxy equivalent of 1 or polyepoxides having a 1,2-epoxy equivalent of 2 or more.

Illustrative examples of the monoepoxides are monoglycidyl ethers of monohydric phenols or alcohols such as phenyl glycidyl ether and butyl glycidyl ether. Examples of polyepoxides are polyglycidyl ethers of polyhydric phenols, which are preferred, such as the polyglycidyl ether of 2,2-bis(4-hydroxyphenyl)propane (bisphenol A) and 1,1-bis (4-hydroxyphenyl)isobutane. Besides polyhydric phenols, other cyclic polyols can be used, particularly cycloaliphatic polyols such as hydrogenated bisphenol A. In addition, polyglycidyl ethers of polyhydric alcohols such as ethylene glycol, 1,2-propylene glycol and 1,4-butylene glycol can be used. Mixtures of monoepoxides and polyepoxides may also be used.

Organophosphonates can be phosphonic acid esters prepared from the reaction of phosphonic acid and a 1,2-epoxide such as the monoepoxides and polyepoxides described above. Examples of suitable phosphonic acids are those having at least one group of the structure: where R is

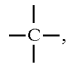

preferably $CH_2$ and more preferably $HO—CO—(CH_2)_2.—$. Examples of useful phosphonic acids include 1-hydroxyethylidene-1,1-diphosphonic acid, carboxyethyl phosphonic acid and alpha-aminomethylene phosphonic acids i.e., those where R is:

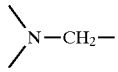

such as (2-hydroxyethyl)aminobis(methylenephosphonic) acid and isopropylaminobis (methylenephosphonic) acid.

The aminomethylene phosphonic acids are described in U.S. Pat. No. 5,034,556, column 2, line 52 to column 3, line 43. Also when phosphonic acid is used, the preferred phosphonic acid as in the 5,306,526 NUPAL® patent can be benzylaminobis-(methylenephosphonic) acid.

Examples of suitable organophosphonates include the carboxyethylene phosphonic acid esters of butyl diglycidyl ether, cyclohexyl diglycidyl ether, phenylglycidyl ether and bisphenol A diglycidyl ether and mixtures thereof.

The organophosphate or organophosphonate should be soluble in an aqueous medium to the extent of at least 0.03 grams per 100 grams of water at 25° C. An aqueous medium is meant to include water and may include a cosolvent such as an alkyl ether of glycol such as 1-methoxy-2-propanol, dimethylformamide and xylene, or a base such as an amine which can partially or completely neutralize the organophosphate or organophosphonate to enhance the solubility of these compounds. Preferably, the amine is the aqueous amine fluoride neutralizing composition of the present invention. The organophosphate or organophosphonate is typically present in the non-chrome pretreatment composition in concentrations between 20 to 60 percent by weight based on the weight of the pretreatment composition. At this point, the pretreatment composition is sometimes referred to as a pretreatment concentrate, and to make a working, preferably, non-chrome pretreatment bath, the concentrate may be diluted with water to lower the resin solids to 0.1 to 10 percent by weight, preferably to 1 to 5 percent by weight.

The metal pretreatment composition also contains fluoride ions. The fluoride ions are preferably supplied by the aqueous amine fluoride neutralizing composition of the present invention. The acidic fluoride supplied by the amine fluoride neutralizing composition is typically present in the non-chrome pretreatment composition in amounts between 100 to 40,000 parts per million (ppm), preferably between 300 to 20,000 ppm.

The preferred non-chrome pretreatment composition typically contains a weight ratio of organophosphate or organophosphonate to fluoride ion in the range of 10:1 to 55:1. Additionally, the preferred non-chrome pretreatment composition will typically have a pH of less than 6.0, more preferably 2.0 to 5.0, and most preferably from 2.7 to 3.5. The pH can be adjusted by the addition of a base such as sodium hydroxide or preferably with the amine fluoride neutralizing composition of the present invention. A pH level lower than 2.0 is not preferred because of a decrease in performance (i.e., an increase of corrosion) and "burning" or blackening of nonferrous metal substrates. Also, a pH level above 5.0 can be used but it is less effective for corrosion resistance.

The metal substrates on which the non-chrome pretreatment composition is effective include zinc, aluminum, and their alloys, and are preferably nonferrous. The aluminum alloys can include aluminum with copper, chromium, magnesium, manganese, nickel, and silicon and the like known to those skilled in the art. A typical treatment process would include cleaning the metal substrate by physical or chemical means, such as mechanically abrading the surface or cleaning with commercial alkaline/caustic cleaners. The cleaning process is then usually followed by a water rinse and contacting the substrate with the non-chrome pretreatment composition, typically by immersion, spray or roll-coating.

Optionally, the treated substrate may be post-rinsed with an aqueous solution of an alkaline earth salt such as an alkaline earth nitrate. Examples of acceptable alkaline earth nitrates include calcium nitrate, magnesium nitrate, and strontium nitrate, with calcium nitrate being preferred. The use of alkaline earth nitrates are believed to enhance corrosion protection of nonferrous metal substrates by forming insoluble complexes with excess fluoride ions. Furthermore, the substrate may be post-oiled with a lubricating oil prior to transportation or storage.

One advantage of the aqueous amine fluoride neutralizing composition of the present invention is that it allows for a simplified manufacturing process for non- chrome or no added chrome metal pretreatment compositions. The pretreatment compositions prepared with the aqueous amine fluoride neutralizing composition of the present invention are less corrosive than hydrofluoric acid and easier to handle. The concentrate and bath compositions can utilize the amine fluoride neutralizing composition rather than using three separate materials, the amine, the hydrofluoric acid and, optionally, a complex fluoride containing compound, of which the acids can be hazardous materials to handle. In addition the amine fluoride neutralizing composition of the present invention may be used as a replenisher for the bath for pH adjustments and for the addition of acidic fluoride to fluoride deficient pretreatment baths normally done with hydrofluoric acid. In addition, this method of fluoride insertion precludes the introduction of extraneous cations which can destabilize or diminish the effectiveness of the pretreatment concentrate or bath.

The invention will be further described by reference to the following examples which are presented for the purpose of illustration only and are not intended to limit the scope of the invention.

EXAMPLES

Examples A through I show the preparation of aqueous amine fluoride neutralizing compositions of the present invention made with various amines and at different levels of pH. Examples A, B and C show the preparation of aqueous amine fluoride compositions at various levels of pH using a secondary amine. Example D shows the preparation of an aqueous amine fluoride neutralizing composition using a tertiary amine while Examples E through G use a primary amine. Examples H and I show the preparation of aqueous amine fluoride neutralizing compositions containing hydrofluozirconic acid at various levels of pH.

Table I below shows the preparation of aqueous amine fluoride neutralizing composition of Examples A through and including Example D. These examples involved the addition of the amount for aqueous hydrofluoric acid ("HF") having the stated percentage of HF to the stated amount of the recited amine in the stated percentage in aqueous solution. The addition was over a period of one minute and was at ambient temperature. A mild exotherm occurred. The resultant aqueous amine fluoride neutralizing composition was determined to have the noted characteristics shown in Table I. The procedure for preparing Examples E through G of Table I differed from the procedure for preparing Examples A through D in that the acid was added to the amine over 3 minutes. The preparation of compositions of Examples H and I of Table I differed from that of Examples A through D in that both acids were added to the amine over one minute. In Table I the weight percent is a calculated number of the weight of the solids of the components in the total weight of the composition, and the pH was measured with a conventional pH meter. The appearance was visually observed.

TABLE I

| | Examples of Amine Fluoride Neutralizing Composition with amounts in grams (Weight Percent) Example | | | | | | | | |
|---|---|---|---|---|---|---|---|---|---|
| | A | B | C | D | E | F | G | H | I |
| A) Components | | | | | | | | | |
| hydrofluoric acid (49%) | 6.0 (2.9) | 24.0 (10) | 45.1 (15.9) | 6.0 (2.9) | 6.0 (2.9) | 20 (19.6) | 30 (24.5) | — | 45.1 (13.7) |
| hydrofluoric acid (70%) | | | | | | | | 4.0 (2.8) | |
| hydrofluoro zirconic acid (50%) | | | | | | | | 18.0 (9) | 21.7 (6.75) |
| DIPA[1] (85%) | 94.0 (80) | 94.0 (68) | 94.0 (57.4) | — | — | — | — | 78.0 (66.3) | 94.0 (49.7) |
| triethylamine | | | | 94.0 (94) | — | — | — | — | — |
| monoethanolamine | | | | | 94.0 (94) | 30 (60) | 30 (50) | — | — |
| B) Characteristics of amine fluoride neutralizing composition | | | | | | | | | |
| Weight Percent Solids | 82.8 | 77.7 | 73.3 | 96.9 | 96.9 | 79.6 | 74.5 | 78.1 | 70.1 |
| pH | 9.4 | 7.3 | 5.2 | 8.0 | 11.7 | 10.2 | 5.2 | 9.4 | 4.6 |
| A/F Rati[o2] | 27.1/1 | 6.8/1 | 3.6/1 | 32.0/1 | 32.0/1 | 3.1/1 | 2.0/1 | 8.8/1 | 2.8/1 |
| appearance | C,H,PYC[3] | C,H,PYC[3] | C,H,PYC[3] | C,H,PYC[3] | C,H,PYC[3] | C,H,PYC[3] | C,H,PGC[4] | C,H,PYC[3] | C,H,PYC[3] |

[1]diisopropanolamine.
[2]amine to fluoride ratio.
[3]C,H,PYC is clear, homogeneous, pale yellow cast.
[4]C,H,PGC is clear, homogeneous, pale green cast.

The weight percentage in the parenthesis is of the solids of the component for the total weight of the composition including solvent (water).

Examples 1 and 2 show the preparation of aqueous non-chrome pretreatment compositions by the method of the present invention. Example J shows the preparation of an organophosphate used in Examples 1 and 2.

EXAMPLE J

Preparation of EPON 828 Organophosphate

The phosphoric acid ester of bisphenol A diglycidyl ether (EPON 828 available from Shell Chemical Company) was made by first charging 491.7 grams of 85% phosphoric acid into a 5 liter flask under a nitrogen blanket which was maintained throughout the reaction. Then 105.6 grams of 1-methoxy-2-propanol was added. The mixture was heated to 100° C. followed by the addition of 1504 grams of EPON 828 premixed with 1-methoxy-2-propanol (70 to 30 weight ratio) over 54 minutes. The temperature of the reaction mixture was maintained at about 103° C. When the addition was complete, the temperature was held at about 100° C. for another 66 minutes followed by the addition of 288 grams of deionized water over a 5 minute period. When the water addition was completed, the mixture was held for 2 hours at about 100° C. followed by cooling. The pH of the mixture was about 0.5.

EXAMPLE 1

Preparation of a Non-chrome Pretreatment Composition

At ambient temperature a non-chrome pretreatment composition was made using the method of the present invention by adding 20.0 grams of the aqueous amine fluoride neutralizing composition of Example A over about 3 minutes to 70.0 grams of the organophosphate of Example J. A mild exotherm occurred. When the addition was complete, 10 grams of deionized water was added over a 1 minute period. The resultant non-chrome pretreatment composition was a clear homogeneous solution with a pale yellow cast and had a pH of 4.6 and a total solids content of 50 percent by weight. A non-chrome pretreatment bath containing 5 percent solids was then made by mixing 1 part of the 50 percent solids composition with 9 parts of water.

EXAMPLE 2

Preparation of a Non-chrome Pretreatment Composition

At ambient temperature a non-chrome pretreatment composition was made using the method of the present invention by adding 100.0 grams of the aqueous amine fluoride neutralizing composition of Example H over about 3 minutes to 286.0 grams of the organophosphate Example J. A mild exotherm occurred. When the addition was complete, 614 grams of deionized water was added over a 1 minute period. The resultant non-chrome pretreatment composition was a clear homogeneous solution with a pale yellow cast and had a pH of 2.8 and a total solids content of 20 percent by weight. A non-chrome pretreatment bath containing 5 percent solids was then made by mixing 1 part of the 20 percent solids composition with 3 parts of deionized water.

What is claimed is:

1. An aqueous amine fluoride neutralizing composition comprised of (a) about 1 to 50 weight percent hydrofluoric acid, (b) optionally up to 18 weight percent of a complex fluoride containing compound, and (c) about 45 to 99 weight percent of an amine; wherein the weight percentages are based on the total weight of the amine fluoride neutralizing composition.

2. The aqueous amine fluoride composition of claim 1 wherein the amine is selected from the group consisting of diisopropanolamine, triethanolamine, triethylamine, monoethanolamine, dimethylethanolamine, and 2-amino-2-methylpropanol.

3. The aqueous amine fluoride composition of claim 1 wherein the amine is diisopropanolamine.

4. The aqueous amine fluoride composition of claim 1 wherein the complex fluoride containing compound is selected from the group consisting of fluorotitanic acid, fluorozirconic acid, potassium hexafluorotitanate, potassium hexafluorozirconate, and mixtures thereof.

5. The aqueous amine fluoride composition of claim 1 wherein the complex fluoride containing compound is fluorozirconic acid.

6. The aqueous amine fluoride composition of claim 1 which has a pH in the range of about 4 to about 12.

7. The aqueous amine fluoride composition of claim 1 which has a pH in the range of about 8 to about 10.

8. The aqueous amine fluoride composition of claim 1 wherein the ratio of amine to fluoride ranges from about 1.5:1 to about 35:1.

9. The aqueous amine fluoride composition of claim 1 wherein the ratio of amine to fluoride ranges from about 5:1 to about 28:1.

10. A method of producing an aqueous non-chrome pretreatment composition comprising:

(a) mixing from about 20 to about 30 weight percent of the aqueous amine fluoride neutralizing composition of claim 1 with about 70 to about 80 weight percent of at least one organic resinous material having an organic resinous material that is neutralizable with amine, where the weight percentages based on resin solids; and (b) adding water to achieve a total solids content of about 20 to about 60 weight percent.

11. The method of claim 10 wherein the non-chrome pretreatment composition has a pH in the range of about 2.0 to about 5.0.

12. The method of claim 10 wherein the organic resinous material is selected from the group consisting of epoxy esters of phosphoric acid, epoxy esters of phosphonic acid, and mixtures thereof.

13. The method of claim 10 wherein the epoxy compound used in forming the epoxy esters is a 1,2-epoxy compound having an epoxy functionality of at least one.

14. The method of claim 10 wherein the epoxy compound used in forming the epoxy esters contains an aromatic or a cycloaliphatic group.

15. The method of claim 10 wherein the phosphonic acid is an alpha-carboxyethylene phosphonic acid having at least one group of the structure.

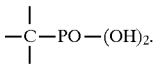

16. The method of claim 10 wherein the weight ratio of epoxy ester to fluoride ion is between about 10:1 and about 55:1.

* * * * *